United States Patent [19]

Limburg et al.

[11] 4,050,935

[45] Sept. 27, 1977

[54] TRIGONAL SE LAYER OVERCOATED BY BIS(4-DIETHYLAMINO-2-METHYL-PHENYL)PHENYLMETHANE CONTAINING POLYCARBONATE

[75] Inventors: William W. Limburg, Penfield; John F. Yanus, Webster; Damodar M. Pai, Fairport, all of N.Y.

[73] Assignee: Xerox Corporation, Stamford, Conn.

[21] Appl. No.: 673,235

[22] Filed: Apr. 2, 1976

[51] Int. Cl.[2] ..... G03G 5/04; G03G 5/08

[52] U.S. Cl. ..... 96/1 PC; 96/1.5 R; 96/1.6

[58] Field of Search ..... 96/1.5, 1.6, 1 PC; 252/501

[56] References Cited

U.S. PATENT DOCUMENTS

| | | | |
|---|---|---|---|
| 3,787,208 | 1/1974 | Jones | 96/1.5 X |
| 3,813,242 | 5/1974 | Ikeda et al. | 96/1.6 X |
| 3,884,691 | 5/1975 | Rochlitz | 96/1.6 |
| 3,904,407 | 9/1975 | Regensburger et al. | 96/1.5 |
| 3,911,091 | 10/1975 | Karam et al. | 96/1.5 X |
| 3,926,762 | 12/1975 | Goldstein | 96/1.5 X |
| 3,954,464 | 5/1976 | Karam et al. | 96/1.5 |
| 3,956,524 | 5/1976 | Weigl | 96/1.5 X |
| 3,961,953 | 6/1976 | Millonzi et al. | 96/1.5 |
| 3,982,937 | 9/1976 | Wiedemann | 96/1.5 |

FOREIGN PATENT DOCUMENTS

| | | | |
|---|---|---|---|
| 763,540 | 8/1971 | Belgium | 96/1.5 |
| 964,873 | 7/1964 | United Kingdom | 96/1.6 |
| 1,343,671 | 1/1974 | United Kingdom | 96/1.5 |

*Primary Examiner*—Roland E. Martin, Jr.

*Attorney, Agent, or Firm*—James J. Ralabate; James Paul O'Sullivan; Ronald L. Lyons

[57] ABSTRACT

A photosensitive member having at least two electrically operative layers is disclosed. The first layer comprises trigonal selenium which is capable of photogenerating holes and injecting the photo-generated holes into a contiguous charge transport layer. The charge transport layer comprises a transparent electrically inactive organic resinous material containing from about 15 to about 75 percent by weight (throughout) of bis(4-diethylamino-2-methylphenyl)phenylmethane. The charge transport layer while substantially non-absorbing in the spectral region of intended use, is "active" in that it allows injection of photo-generated holes from the trigonal selenium carrier generating layer, and allows these photo-generated holes to be transported through the charge transport layer. This structure may be imaged in the conventional xerographic mode which usually includes charging, exposure to light and development.

28 Claims, 4 Drawing Figures

TRIGONAL SE LAYER OVERCOATED BY BIS(4-DIETHYLAMINO-2-METHYLPHENYL)-PHENYLMETHANE CONTAINING POLYCARBONATE

BACKGROUND OF THE INVENTION

This invention relates in general to xerography and, more specifically, to a novel photosensitive device and method of use.

In the art of xerography, a xerographic plate containing a photoconductive insulating layer is imaged by first uniformly electrostatically charging its surface. The plate is then exposed to a pattern of activating electromagnetic radiation such as light, which selectively dissipates the charge in the illuminated areas of the photoconductive insulator while leaving behind a latent electrostatic image in the non-illuminated areas. This latent electrostatic image may then be developed to form a visible image by depositing finely divided electroscopic marking particles on the surface of the photoconductive insulating layer.

A photoconductive layer for use in xerography may be a homogeneous layer of a single material such as vitreous selenium or it may be a composite layer containing a photoconductor and another material. One type of composite photoconductive layer used in xerography is illustrated by U.S. Pat. No. 3,121,006 to Middleton and Reynolds which describes a number of layers comprising finely divided particles of a photoconductive inorganic compound dispersed in an electrically insulating organic resin binder. In its present commercial form, the binder layer contains particles of zinc oxide uniformly dispersed in a resin binder and coated on a paper backing.

In the particular examples described in Middleton et al, the binder comprises a material which is incapable of transporting injected charge carriers generated by the photoconductor particles for any significant distance. As a result, with the particular material disclosed in Middleton et al patent, the photoconductor particles must be, in substantially continuous particle-to-particle contact throughout the layer in order to permit the charge dissipation required for stable cyclic operation. Therefore, with the uniform dispersion of photoconductor particles described in Middleton et al, a relatively high volume concentration of photoconductor, about 50 percent by volume, is usually necessary in order to obtain sufficient photoconductor particle-to-particle contact for rapid discharge. However, it has been found that high photoconductor loadings in the binder results in the physical continuity of the resin being destroyed, thereby significantly reducing the mechanical properties of the binder layer. Systems with high photoconductor loadings are often characterized as having little or no flexibility. On the other hand, when the photoconductor concentration is reduced appreciably below about 50 percent by volume, the photo-induced discharge rate is reduced, making high speed cyclic or repeated imaging difficult or impossible.

U.S. Pat. No. 3,121,007 to Middleton et al teaches another type of photoreceptor which includes a two-phase photoconductive layer comprising photoconductive insulating particles dispersed in a homogeneous photoconductive insulating matrix. The photoreceptor is in the form of a particulate photoconductive inorganic pigment broadly disclosed as being present in an amount from about 5 to 80 percent by weight. Photodischarge is said to be caused by the combination of charge carriers generated in the photoconductive insulating matrix material and charge carriers injected from the photoconductive pigment into the photoconductive insulating matrix.

U.S. Pat. No. 3,037,861 to Hoegl et al teaches that poly(vinylcarbazole) exhibits some long-wave U.V. sensitivity and suggests that its spectral sensitivity be extended into the visible spectrum by the addition of dye sensitizers. Hoegl et al further suggest that other additives such as zinc oxide or titanium dioxide may also be used in conjunction with poly(vinylcarbazole). In Hoegl et al, the poly(vinylcarbazole) is intended to be used as a photoconductor, with or without additive materials which extend its spectral sensitivity.

In addition to the above, certain specialized layered structures particularly designed for reflex imaging have been proposed. For example, U.S. Pat. No. 3,165,405 to Hoesterey utilizes a two layered zinc oxide binder structure for reflex imaging. The Hoesterey patent utilizes two separate contiguous photoconductive layers having different spectral sensitivies in order to carry out a particular reflex imaging sequence. The Hoesterey device utilizes the properties of multiple photoconductive layers in order to obtain the combined advantages of the separate photoresponse of the respective photoconductive layers.

It can be seen from a review of the conventional composite photoconductive layers cited above, that upon exposure to light, photoconductivity in the layered structure is accomplished by charge transport through the bulk of the photoconductive layer, as in the case of vitreous selenium (and other homogeneous layered modifications). In devices employing photoconductive binder structures which include inactive electrically insulating resins such as those described in the Middleton et al, U.S. Pat. No. 3,121,006, conductivity or charge transport is accomplished through high loadings of the photoconductive pigment allowing particle-to-particle contact of the photoconductive particles. In the case of photoconductive particles dispersed in a photoconductive matrix, such as illustrated by the Middleton et al U.S. Pat. No. 3,121,007 photoconductivity occurs through the generation and transport of charge carriers in both the photoconductive matrix and the photoconductor pigment particles.

Although the above patents rely upon distinct mechanisms of discharge throughout the photoconductive layer, they generally suffer from common deficiencies in that the photoconductive surface during operation is exposed to the surrounding environment, and particularly in the case of repetitive xerographic cycling where these photoconductive layers are susceptible to abrasion, chemical attack, heat and multiple exposures to light. These effects are characterized by a gradual deterioration in the electrical characteristics of the photoconductive layer resulting in the printing out of surface defects and scratches, localized areas of persistent conductivity which fail to retain an electrostatic charge, and high dark discharge.

In addition to the problems noted above, these photoreceptors require that the photoconductor comprise either a hundred percent of the layer, as in the case of the vitreous selenium layer, or that they preferably contain a high proportion of photoconductive material in the binder configuration. The requirements of a photoconductive layer containing all or a major proportion of a photoconductive material further restricts the physical characteristics of the final plate, drum or belt in that the physical characteristics such as flexibility and adhesion of the photoconductor to a supporting substrate are primarily dictated by the physical properties of the photoconductor, and not by the resin or matrix material which is preferably present in a minor amount.

Another form of a composite photosensitive layer which has also been considered by the prior art includes a layer of photoconductive material which is covered with a relatively thick plastic layer and coated on a supporting substrate.

U.S. Pat. No. 3,041,166 to Bardeen describes such a configuration in which a transparent plastic material overlays a layer of vitreous selenium which is contained on a supporting substrate. In operation, the free surface of the transparent plastic is electrostatically charged to a given polarity. The device is then exposed to activating radiation which generates a hole-electron pair in the photoconductive layer. The electrons move through the plastic layer and neutralize positive charges on the free surface of the plastic layer thereby creating an electrostatic image. Bardeen, however, does not teach any specific plastic materials which will function in this manner, and confines his examples to structures which use a photoconductor material for the top layer.

French Pat. No. 1,577,855 to Herrick et al describes a special purpose composite photosensitive device adapted for reflex exposure by polarized light. One embodiment which employs a layer of dichroic organic photoconductive particles arrayed in oriented fashion on a supporting substrate and a layer of poly(vinylcarbazole) formed over the oriented layer of dichoric material. When charged and exposed to light polarized perpendicularly to the orientation of the dichroic layer, the oriented dichoric layer and poly(vinylcarbazole) layer are both substantially transparent to the initial exposure light. When the polarized light hits the white background of the document being copied, the light is depolarized, reflected back through the device and absorbed by the dichroic photoconductive material. In another embodiment, the dichroic photoconductor is dispersed in oriented fashion throughout the layer of poly(vinylcarbazole).

Shattuck et al, U.S. Pat. No. 3,837,851, disclose a particular electrophotographic member having a charge generation layer and a separate charge transport layer. The charge transport layer comprises at least one tri-aryl pyrazoline compound. These pyrazoline compounds may be dispersed in binder material such as resins known in the art.

Cherry et al, U.S. Pat. No. 3,791,826, discloses an electrophotographic member comprising a conductive substrate, a barrier layer, an inorganic charge generation layer and an organic charge transport layer comprising at least 20 percent by weight trinitrofluorenone.

Belgium Pat. No. 763,540, issued Aug. 26, 1971 (U.S. application Ser. No. 94,139, filed Dec. 1, 1970, now abandoned) discloses an electrophotographic member having at least two electrically operative layers. The first layer comprises a photoconductive layer which is capable of photogenerating charge carriers and injecting the photo-generated holes into a contiguous active layer. The active layer comprises a transparent organic material which is substantially non-absorbing in the spectral region of intended use, but which is "active" in that it allows injection of photo-generated holes from the photoconductive layer, and allows these holes to be transported to the active layer. The active polymers may be mixed with inactive polymers or nonpolymeric material.

Wilson, U.S. Pat. No. 3,542,547, discloses photoconductive elements containing stable organic photoconductors such as triarylmethane leuco bases. More specifically, Wilson discloses a photoconductive element for use in electrophotography comprising a support having coated thereon a photoconductive insulating layer which comprises an organic photoconductor dispersed in a film-forming insulating resin binder. The photoconductor may be 4,4'-bis(diethylamino)-2,2'-dimethyltriphenylmethane.

Rule et al, U.S. Pat. No. 3,820,989, discloses certain triarylmethane leuco bases which may be used as photoconductive materials dispersed in an insulating resin binder.

Robinson, U.S. Pat. No. 3,533,783, discloses a photoconductive element which comprises a conductive support having coated thereon a layer of a composition comprising a binder, a sensitizer and an organic photoconductor which is overcoated with a layer of a composition comprising a binder and an organic photoconductor. The organic photoconductor may be 4,4'-diethylamino-2,2'-dimethyltriphenylmethane.

Gilman, Defensive Publication of Ser. No. 93,449 filed Nov. 27, 1970, published in 888 O.G. 707 on July 20, 1970, Defensive Publication No. P888,013, U.S. Cl. 96–1.5, discloses that the speed of an inorganic photoconductor such as amorphous selenium, can be improved by including an organic photoconductor in the electrophotographic element. For example, an insulating resin binder may have $TiO_2$ dispersed therein or it may be a layer of amorphous selenium. This layer is overcoated with a layer of electrically insulating binder resin having an organic photoconductor such as 4,4'-diethylamino-2,2'-dimethyltriphenylmethane dispersed therein.

"Multi-Active Photoconductive Element", Martin A. Berwick, Charles J. Fox and William A. Light, Research Disclosure, Vol. 133; pages 38–43, May 1975, was published by Industrial Opportunities Ltd., Homewell, Havant, Hampshire, England. This disclosure relates to a photoconductive element having at least two layers comprising an organic photoconductor containing a charge-transport layer in electrical contact with an aggregate charge-generation layer. Both the charge-generation layer and the charge-transport layer are essentially organic compositions. The charge-generation layer contains a continuous electrically insulating polymer phase and a discontinuous phase comprising a finely-divided, particulate co-crystalline complex of (1) at least one polymer having an alkylidene diarylane group in a recurring unit and (2) at least one pyrylium-type dye salt. The charge-transport layer is an organic material which is capable of accepting and transporting injected charge carriers from the charge-generation layer. This layer may comprise an insulating resinous material having 4,4'-bis(diethylamino)-2,2'-dimethyltriphenylmethane dispersed therein.

None of the above mentioned art discloses the specific advantages of inorganic charge generating material, i.e., trigonal selenium, of the instant invention in combination with a transport layer comprising an insulating resinous material having bis(4-diethylamino-2-methylphenyl)phenylmethane dispersed therein. This electrically insulating resinous matrix material comprises a polycarbonate. The charge transport material is substantially non-absorbing in the spectral region of intended use, but is "active" in that it allows injection of photo-generated holes from the trigonal selenium layer and allows these holes to be transported therethrough. The charge-generating layer is trigonal selenium which is capable of photogenerating and injecting holes into the contiguous charge-transport layer. Furthermore, neither does the prior art teach or suggest that one can match any organic photoconductor, i.e., bis(4-diethylamino-2-methylphenyl)phenylmethane, dispersed in an electrically insulating resinous material, i.e., a polycarbonate, as a transport layer with trigonal selenium as the generating material since trigonal selenium, as taught in Keck, U.S. Pat. No. 2,739,079, is quite conductive and would be unsuitable as a generating material as taught in Japanese Publication No. 16,198 of 1968 of Japanese (M. Hayashi) application 73,753 of Nov. 29, 1965, assigned to Matsushita Electric Industrial Company. The Japanese Publication No. 16,198 discloses that one should not use a highly conductive photoconductive layer as a charge generation material in a multilayered device comprising a charge generation layer and an overlayer of charge transport material. Therefore, since Keck U.S. Pat. No. 2,739,079 teaches that trigonal selenium is highly conductive, it would be unobvious to use trigonal selenium in the instant invention as the generating material.

OBJECTS OF THE INVENTION

It is an object of this invention to provide a novel imaging system.

It is a further object of this invention to provide a novel photoconductive device adapted for cyclic imaging which overcomes the above-noted disadvantages.

It is a further object of this invention to provide a photoconductive member comprising trigonal selenium as a charge carrier generating layer and a charge transport layer comprising a polycarbonate as an electrically inactive organic material having dispersed therein bis(4-diethylamino-2-methylphenyl)phenylmethane.

SUMMARY OF THE INVENTION

The foregoing objects and others are accomplished in accordance with this invention by providing a photosensitive member which has at least two operative layers. The first layer comprises a layer of trigonal selenium which is capable of photogenerating and injecting photo-generated holes into a contiguous or adjacent electrically active layer. The electrically active material comprises an electrically inert polycarbonate resin having dispersed therein from about 15 to about 75 percent by weight of bis(4-diethylamino-2-methylphenyl)-phenylmethane. The active layer, i.e., the charge transport layer, is substantially non-absorbing in the spectral region at which the photoconductive material generates and injects holes, but which is "active" in that it is capable of supporting the injection of photo-generated holes from the photoconductive material and transporting these holes through the electrically active material to selectively discharge a surface charge on the free surface of the active layer.

It should be understood that the active layer does not function as a photoconductor in the wavelength region of use. As stated above, hole-electron pairs are photogenerated in the trigonal selenium layer and the holes are then injected into the active layer and hole transport occurs through the active layer to selectively discharge a surface charge on the free surface of the active layer.

A typical application of the instant invention involves the use of a layered configuration member which in one embodiment comprises a supporting substrate such as a conductor containing a trigonal selenium layer thereon. A transparent polymeric layer consisting essentially of an electrically inactive polycarbonate resin containing from about 15 to 75 percent by weight of bis(4-diethylamino-2-methylphenyl)phenylmethane is coated over the trigonal selenium layer. Generally, a thin interfacial barrier or blocking layer is sandwiched between the trigonal selenium layer and the substrate. This barrier layer may comprise any suitable electrically insulating material such as metallic oxide or organic resin. The use of the electrically insulating polycarbonate resin having dispersed therein bis(4-diethylamino-2-methylphenyl)phenylmethane, i.e., the charge transport layer, allows one to take advantage of placing the trigonal selenium adjacent to a supporting substrate and protecting the trigonal selenium layer with a top surface which will allow for the transport of photo-generated holes from the trigonal selenium layer, and at the same time functions to physically protect the trigonal selenium layer from environmental conditions. This structure can then be imaged in the conventional xerographic manner which usually includes charging, exposure and development.

DETAILED DESCRIPTION OF THE DRAWINGS

Figure 1:
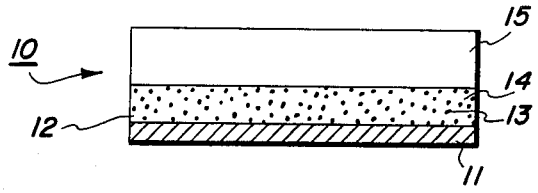
FIG. 1 is a schematic illustration of one embodiment of a device of the instant invention.

FIG. 1 designates imaging member 10 in the form of a plate which comprises a supporting substrate 11 having a binder layer 12 thereon, and a charge transport layer 15 positioned over binder layer 12. Substrate 11 is preferably made up of any suitable conductive material. Typical conductors include aluminum, steel, brass, graphite, dispersed conductive salts, conductive polymers or the like. The substrate may be rigid or flexible and of any conventional thickness. Typical substrates include flexible belts or sleeves, sheets, webs, plates, cylinders and drums. The substrate or support may also comprise a composite structure such as a thin conductive coating contained on a paper base; a plastic coated with a thin conductive layer such as aluminum or copper iodide, or glass coated with a thin conductive coating of chromium or tin oxide.

Binder layer 12 contains trigonal selenium particles 13 dispersed randomly without orientation in a binder 14. The size of the trigonal selenium particles is not particularly critical, but particles in the size of from about 0.01 to 1.0 micron yield particularly satisfactory results.

Binder material 14 may comprise any electrically insulating resin such as those described in the above-mentioned Middleton et al, U.S. Pat. No. 3,121,006. When using an electrically inactive or insulating resin, it is essential that there be particle-to-particle contact between the trigonal selenium particles. This necessitates that the trigonal selenium be present in an amount of at least about 15 percent by volume of the binder layer with no limitation on the maximum amount of trigonal selenium in the binder layer. If the matrix or binder comprises an active material, the trigonal selenium need only to comprise about 1 percent or less by volume of the binder layer with no limitation on the maximum amount of the trigonal selenium in the binder layer. The thickness of the trigonal selenium binder layer is not critical. Layer thicknesses from about 0.05 to 20.0 microns have been found satisfactory, with a preferred thickness of about 0.2 to 5.0 microns yielding good results.

Active layer 15 comprises an electrically inert polycarbonate resin having dispersed therein from about 15 to about 75 percent by weight of bis(4-diethylamino-2-methylphenyl)phenylmethane. Active layer 15 must be capable of supporting the injection of photo-generated holes from the trigonal selenium layer and allowing the transport of these holes through the active layer to selectively discharge a surface charge on the active layer.

Active layer 15, in addition to the transparent electrically inactive polycarbonate resin, contains at least from about 15 to about 75 percent by weight of bis(4-diethylamino-2-methylphenyl)phenylmethane. Unexpectedly, this particular triphenylmethane has unusually good solubility in the electrically inactive polycarbonate resin of the present invention so as to form a molecular dispersion with no apparent sign of crystallinity up to a very high loading, such as loadings over 75 percent.

Electrically active, when used to define active layer 15, e.g., a polycarbonate resin having bis(4-diethylamino-2-methylphenyl)phenylmethane dispersed therein, means that the material is capable of supporting the injection of photo-generated holes from the generating material and capable of allowing the transport of these holes through the active layer in order to discharge a surface charge on the active layer.

In general, the thickness of active layer 15 should be from about 5 to 100 microns, but thicknesses outside this range can also be used.

Figure 2:
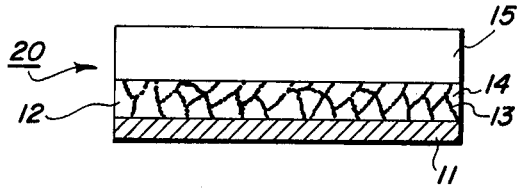
FIG. 2 illustrates a second embodiment of the device for the instant invention.

In another embodiment of the instant invention, the structure of FIG. 1 is modified to insure that the trigonal selenium particles are in the form of continuous chains through the thickness of binder layer 12. This embodiment is illustrated by FIG. 2 in which the basic structure and materials are the same as those in FIG. 1, except the trigonal selenium particles 13 are in the form of continuous chains or continuous paths through the binder layer 12. Layer 14, the generator layer, of FIG. 2 may comprise the structure as described in Jones, U.S. Pat. No. 3,787,208, the entire contents of which is hereby incorporated by reference herein. Layer 14 of FIG. 2 more specifically may comprise trigonal selenium in a multiplicity of interlocking photoconductive continuous paths or continuous chains through the thickness of said layer. The photoconductive paths being present in a volume concentration based on the volume of said layer, of from about 1 to about 25 percent. A further alternative for layer 14 of FIG. 2 comprises trigonal selenium in substantial particle-to-particle contact in the layer in a multiplicity of interlocking photoconductive paths through the thickness of said layer, the photoconductive paths being present in a volume concentration, based on the volume of the layer, of from about 1 to 25 percent. Alternatively, the trigonal selenium layer may consist entirely of a substantially homogeneous trigonal selenium. This modification is illustrated by FIG. 3 in which the photosensitive member 30 comprises a substrate 11, having a homogeneous photoconductive layer 16 which comprises trigonal selenium, with an overlying active layer 15 comprising an electrically inert polycarbonate resin having dispersed therein from about 15 to about 75 percent by weight of bis(4-diethylamino-2-methylphenyl)phenylmethane.

The trigonal selenium utilized in the instant invention as the generation layer may be prepared by several methods. One method comprises vacuum evaporating a thin layer of vitreous selenium onto a substrate, and then forming a relatively thicker layer of the electrically active organic transport material over the selenium layer. Then the device is heated to temperatures from about 125° C. to 210° C. for a sufficient time, e.g., 1 to 24 hours, sufficient to convert the vitreous selenium to the crystalline trigonal form. Another method of obtaining trigonal selenium involves forming a dispersion of finely divided vitreous selenium particles in a liquid organic resin solution and then coating the solution onto a support substrate and drying to form a binder layer comprising vitreous selenium particles contained in an organic resin matrix. Then the member is heated to an elevated temperature, e.g., 110° C. to 140° C. for a sufficient time, e.g., 8 to 24 hours, which converts the vitreous selenium to the crystalline trigonal form.

Figure 3:
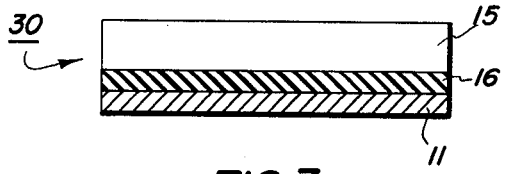
FIG. 3 illustrates a third embodiment of the device of the instant invention.
Figure 4:
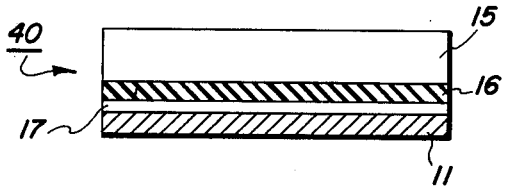
FIG. 4 illustrates a fourth embodiment of the device of the instant invention.

Another modification of the layered configuration is described in FIGS. 1, 2 and 3 which include the use of a blocking layer 17 at the substrate-photoconductor interface. The configuration is illustrated by photosensitive member 40 in FIG. 4 in which the substrate 11 and trigonal selenium layer 16 are separated by a blocking layer 17. The blocking layer functions to prevent the injection of charge carriers from the substrate into the trigonal selenium layer. Any suitable blocking material may be used. Typical materials include nylon, epoxy and aluminum oxide.

As mentioned above, the addition of bis(4-diethylamino-2-methylphenyl)phenylmethane of at least 15 percent by weight, preferably from about 15 percent to about 75 percent by weight, to the electrically inactive polycarbonate resin of the instant invention provides an active material having the required properties such as physical properties, i.e., flexibility, and the required electrical properties. The active layer 15, i.e., the charge transport layer, is non-absorbing to light in the wavelength region used to photo-generate carriers in the trigonal selenium layer, i.e., charge generating layer. This preferred range for xerographic utility is from about 4,000 to 8,000 angstrom units. In addition, the trigonal selenium should be responsive to all wavelengths from 4,000 to 8,000 angstrom units if panchromatic responses are required. The photoconductor-active material combination of the instant invention results in the injection and subsequent transport of holes across the physical interface between the trigonal selenium and the active material.

The reason for the requirement that the active layer 15, i.e., charge transport layer, may be transparent is the fact that most of the incident radiation should be utilized by the trigonal selenium layer, i.e., the charge carrier generator layer, for efficient photo-generation.

It is not the intent of this invention to restrict the choice of electrically inactive polycarbonate resins to those which are transparent within the entire visible region. For example, when used with a transparent substrate, imagewise exposure may be accomplished through the substrate without the light passing through the layer of active material. In this case, the active material may not be non-absorbing in the wavelength region of use. Other applications where complete transparency is not required for the active material in the visible region include the selective recording of narrow-band radiation such as that emitted from lasers, spectral pattern recognition and possible functional color xerography, such as color coded form duplication.

Typical active layers, i.e., charge transport layers, which in this invention comprise an electrically inert polycarbonate resin having dispersed therein from about 15 to about 75 percent by weight of bis(4-diethylamino-2-methylphenyl)-phenylmethane, will exhibit negligible, if any, discharge when exposure to the wavelength of light useful in xerography, i.e., 4,000 to 8,000 angstrom units. Therefore, the obvious improvement in performance which results from the use of the layered systems can best be realized if the active materials, as mentioned above, are substantially transparent to radiation in a region in which the photoconductor is to be used; as mentioned, for any absorption of desired radiation by the active material will prevent this radiation from reaching the trigonal selenium layer, i.e., generator layer, where it is much more effectively utilized. It, therefore, follows that it is advantageous to use an active material which is transparent in the wavelength in which the trigonal selenium has its main response, and particularly in the wavelength in which the trigonal selenium is to be used. The active layer which comprises a transparent electrically inactive polycarbonate resin having dispersed therein from about 15 to about 75 percent by weight of bis(4-diethylamino-2-methylphenyl)phenylmethane, is a substantially non-photoconductive material which supports an injection of photo-generated holes from the photoconductive layer. This material is further characterized by the ability to transport the carrier even at the lowest electrical fields developed in electrophotography. In addition, the active material is substantially transparent in the wavelength region in which the device is to be used.

The active transport layer which is employed in conjunction with the trigonal selenium layer, i.e., generator layer, in the instant invention, is a material which is an insulator to the extent that the electrostatic charge placed on said active layer is not conducted in the absence of illumination, in a rate sufficient to prevent the formation and retention of an electrostatic latent image thereon.

The preferred polycarbonate resins have a molecular weight (Mw) from about 20,000 to about 100,000, more preferably from about 50,000 to about 100,000.

The materials most preferred as the electrically inactive polycarbonate resin is poly(4,4'-isopropylidine-diphenylene carbonate) with a molecular weight (Mw) of from about 35,000 to about 40,000, available as Lexan 145 from General Electric Company; poly(4,4'-isopropylidene-diphenylene carbonate) with a molecular weight (Mw) of from about 40,000 to about 45,000, available as Lexan 141 from the General Electric Company; a polycarbonate having a molecule weight (Mw) of from about 50,000 to about 100,000, available as Makrolon from Farbenfabrickin Bayer A. G. and a polycarbonate having a molecule weight (Mw) of from about 20,000 to about 50,000, available as Merlon from Mobay Chemical Company.

In general, the thickness of the active layer should be from about 5 to 100 microns, but thicknesses outside this range can also be used. The ratio of the thickness of the active layer, i.e., charge transport layer, to the photoconductive layer, i.e., charge generator layer, should be maintained from about 2:1 to 200:1 and in some instances as great as 400:1.

Electrically inactive when used to define the polycarbonate resins, e.g., polycarbonate resins without having bis(4-diethylamino-2-methylphenyl)phenylmethane dispersed therein, means that the polycarbonate resins are not capable of supporting the injection of photogenerated holes from the generating material and are not capable of allowing the transport of these holes through the polycarbonate layer.

The following examples further specifically define the present invention with respect to a method of making a photosentive member containing a trigonal selenium layer, i.e., charge generator layer, contiguous an active organic layer, i.e., a charge transport layer comprising an electrically inactive polycarbonate resin having dispersed therein from about 15 to about 75 percent by weight of bis(4-diethylamino-2-methylphenyl)-phenylmethane. The formula of bis(4-diethylamino-2-methylphenyl)phenylmethane is as follows:

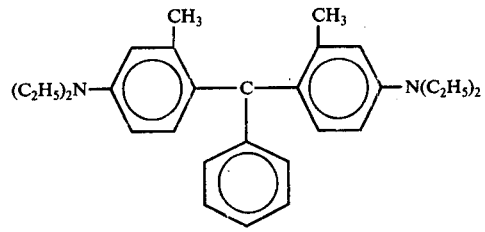

The percentages are by weight unless otherwise indicated. The examples below are intended to illustrate various preferred embodiments of the instant invention.

EXAMPLE I

Preparation of bis(4-diethylamino-2-methylphenyl)-phenylmethane

Into a 100 milliliter round bottom flask fitted with a mechanical stirrer and a dropping funnel is placed 8.85 grams (0.05 moles) of N,N-diethyl-m-toluidine and 3.0 grams (0.03 moles) of benzaldehyde and 10 milliliters and of n-butanol containing, 0.75 grams of concentrated sulfuric acid. The flask is flushed with nitrogen to remove air and refluxed for 18 hours with a nitrogen atmosphere. The material is then cooled to room temperature. A sufficient amount of sodium bicarbonate is added in order to neutralize the acid. 10 milliliters of methanol is added whereby a yellowish white precipitation is formed. The yellowish white material is filtered out. The material may then be washed with cold methanol in order to remove the yellow color. The material may be recrystallized from either methanol or ethanol. In order to further purify the material, it may be put through a neutral alumina column. The material is eluted with benzene. The first material to be fractionated off of the column is a clear liquid. This liquid is placed in a rotary evaporator and the solvent is removed. The residue is either a clear liquid or a white solid. The material may be recrystallized using methanol or ethanol. White crystals are obtained. A 70 percent yield based upon the benzaldehyde is obtained.

The product is vacuum dried in order to remove the remaining solvent.

EXAMPLE II

A photosensitive layered structure similar to that illustrated in FIG. 3 comprises an aluminized Mylar substrate, having a 1 micron layer of amorphous senenium over the substrate, and a 22 micron thick layer of a charge transport material comprising 25 percent by weight of bis(4-diethylamino-2-methylphenyl)-phenylmethane and 75 percent by weight bisphenol-A-polycarbonate (Lexan 145, obtained from General Electric Company) over the amorphous selenium layer. The member is prepared by the following technique:

A 1 micron layer of vitreous selenium is formed over an aluminized Mylar substrate by conventional vacuum deposition technique such as those disclosed by Bixby in U.S. Pat. No. 2,753,278 and U.S. Pat. No. 2,970,906.

A charge transport layer is prepared by dissolving in 135 grams of methylene chloride, 3,34 grams of bis(4-diethylamino-2-methylphenyl)phenylmethane as prepared in Example I and 10 grams of bisphenol-A-polycarbonate (Lexan 145, obtained from General Electric Company). A layer of the above mixture is formed on the vitreous selenium layer using a Bird Film Applicator. The coating is then vacuum dried at 40° C. for 18 hours to form a 22 micron thin dry layer of charge transport material.

The above member is then heated to about 125° C. for 16 hours which is sufficient to convert the vitreous selenium to the crystalline trigonal form.

The plate is tested electrically by charging the plate to a field of 60 volts/micron and discharging it at a wavelength of 4,200 angstrom units at $2 \times 10^{12}$ photons/cm$^2$ seconds. The plate exhibits satisfactory discharge at the above fields and is capable of use in forming visible images.

EXAMPLE III

A photosensitive layer structure similar to that illustrated in EXAMPLE I comprising an aluminized Mylar substrate, having a 1 micron layer of trigonal selenium over the substrate, and a 22 micron thick layer of a charge transport layer comprising 50 percent by weight of bis(4-diethylamino-2-methylphenyl)-phenylmethane and 50 percent by weight bisphenol-A-polycarbonate (Lexan 141, obtained from General Electric Company) is overcoated onto the trigonal selenium layer. The member is prepared by the following technique:

A 1 micron layer of amorphous selenium is vacuum evaporated on a 3 mil aluminum substrate by conventional vacuum deposition technique such as those disclosed by Bixby in U.S. Pat. Nos. 2,753,278 and 2,970,906. Prior to evaporating the amorphous selenium onto the substrate, a 0.5 micron layer of an epoxy-phenolic barrier layer is formed over the aluminum by dip coating. Vacuum deposition is carried out at a vacuum of $10^{-6}$ Torr while the substrate is maintained at a temperature of about 50° C. during the vacuum deposition. A 22 micron thick layer of charge transport material comprising 50 percent by weight of bis(4-diethylamino-2-methylphenyl)phenylmethane and 50 percent by weight of poly(4,4'-isopropylidine-diphenylene carbonate) having a Mw of about 40,000 (available as Lexan 141 from General Electric Company) is coated over the amorphous selenium layer.

The charge transport layer is prepared by dissolving in 135 grams of methylene chloride, 10 grams of bis(4-diethylamino-2-methylphenyl)phenylmethane and 10 grams of poly(4,4'-isopropylidene-diphenylene carbonate) (Lexan 141, having a Mw of about 40,000 obtained from General Electric Company). A layer of the above mixture as mentioned above is formed on the amorphous selenium layer by using a Bird Film Applicator. The coating is then dried at 40° C. for 18 hours to form a 22 micron thick dry layer of charge transport material. The amorphous selenium layer is then converted to the crystalline trigonal form by heating the entire device to 125° C. and maintaining this temperature for about 16 hours. At the end of 16 hours, the device is cooled to room temperature. The plate is tested electrically by charging the plate to fields of 60 volts/micron and discharging them at a wavelength of 4,200 angstroms at $2 \times 10^{12}$ photons/cm$^2$ seconds. The plate exhibits satisfactory discharge at the above fields, and is capable of use in forming visible images.

EXAMPLE IV 0.328 grams of poly(N-vinylcarbazole) and 0.0109 grams of 2,4,7-trinitro-9-fluorenone are dissolved in 14 ml of benzene. 0.44 grams of submicron trigonal selenium particles are added to the mixture. The entire mixture is ball milled on a Red-Devil paint shaker for 15 to 60 minutes in a 2 oz. amber colored glass jar containing 100 grams of ⅛ inch diameter steel shot. Approximately a 2 micron thick layer of the slurry is coated on an aluminized Mylar substrate precoated with an approximately 0.5 micron flexclad adhesive interface which acts as a blocking layer. This member is evaporated at 100° C. for 24 hours and then slowly cooled to room temperature. The charge transport layer is prepared by dissolving in 135 grams of methylene chloride 10 grams of bis(4-diethylamino-2-methylphenyl)-phenylmethane as prepared in Example I and 10 grams of Makrolon, a polycarbonate having a molecule weight (Mw) of about 100,000 and available from Farbenfabricken Bayer A.G. A 22 micron layer of the above mixture is coated on the trigonal selenium layer by use of a Bird Applicator. The coating is then dried at 40° C. for 18 hours.

The plate is tested electrically by charging the plate to a field of 60 volts/micron and discharging it at a wavelength of 4,200 angstrom units at $2 \times 10^{12}$ photons/cm$^2$ seconds. The plate exhibits satisfactory discharge at the above fields and is capable of use in forming visible images.

In addition, if desired, an electrically insulating substrate may be used. In this instance, the charge may be placed upon the imaging member by double corona charging techniques well known and disclosed in the art. Other modifications using an insulating substrate or no substrate at all include placing the imaging member on a conductive backing member or plate and charging the surface while in contact with such backing member. Subsequent to imaging, the imaging member may then be stripped from the conductive backing.

Although specific comments and proportions have been stated in the above description of the preferred embodiments of the present invention, other modifications and ramifications of the present invention would appear to those skilled in the art upon reading the disclosure, these also are intended to be covered in the scope of this invention.

What is claimed is:

1. An imaging member comprising a layer of trigonal selenium and a contigous layer of electrically active material consisting essentially of an electrically inactive polycarbonate resin having dispersed therein from about 15 to about 75 percent by weight of bis(4-diethylamino-2-methylphenyl)phenylmethane said trigonal selenium exhibiting the capability of photogeneration of holes and injection of said holes and said electrically active material being substantially non-absorbing in the spectral region at which the trigonal selenium generates and photo-generated holes but being capable of supporting the injection of photo-generated holes from said trigonal selenium and transporting said holes through said electrically active material.

2. The member according to claim 1 wherein the polycarbonate resin has a Mw of from about 20,000 to about 100,000.

3. The member according to claim 1 wherein the polycarbonate has a Mw of from about 20,000 to about 50,000.

4. The member according to claim 1 wherein the polycarbonate resin has a Mw of from about 50,000 to about 100,000.

5. The member according to claim 1 wherein the polycarbonate resin is poly(4,4'-isopropylidene-diphenylene carbonate) having a Mw of from about 35,000 to about 40,000.

6. The member according to claim 1 wherein the polycarbonate is poly(4,4'-isopropylidene-diphenylene carbonate) having a Mw of from about 40,000 to about 45,000.

7. An imaging member comprising a photoconductive layer of trigonal selenium dispersed in a resinous binder and a contiguous layer of electrically active material consisting essentially of an electrically inactive polycarbonate resin having dispersed therein from about 15 to about 75 percent by weight of bis(4-diethylamino-2-methylphenyl)phenylmethane, said trigonal selenium exhibiting the capability of photo-generation of holes and injection of said holes and said electrically active material being substantially non-absorbing in the spectral region at which the trigonal selenium generates and injects photo-generated holes but being capable of supporting, the injection of photo-generated holes from said trigonal selenium and transporting said holes through said electrically active material.

8. The member according to claim 7 wherein the polycarbonate resin has a Mw of from about 20,000 to about 100,000.

9. The member according to claim 7 wherein the polycarbonate resin has a Mw of from about 20,000 to about 50,000.

10. The member according to claim 7 wherein the polycarbonate resin has a Mw of from about 50,000 to about 100,000.

11. The member according to claim 7 wherein the polycarbonate resin is poly(4,4'-isopropylidene-diphenylene carbonate) having a Mw of from about 35,000 to about 40,000.

12. The member according to claim 7 wherein the polycarbonate resin is poly(4,4'-isopropylidene-diphenyl carbonate) having a Mw of from about 40,000 to about 45,000.

13. An imaging member comprising a photoconductive layer comprising an insulating organic resin matrix and trigonal selenium, with substantially all of the trigonal selenium in said layer in a multiplicity of interlocking photoconductive continuous paths through the thickness of said layer, said photoconductive paths being present in a volume concentration, based on the volume of said layer, of from about 1 to 25 percent and a contiguous layer of electrically active material consisting essentially of an electrically inactive polycarbonate resin having dispersed therein from about 15 to 75 percent by weight of bis(4-diethylamino-2-methylphenyl)phenylmethane, said photoconductive layer exhibiting the capability of photo-generation of holes and injection of said holes and said electrically active material being substantially non-absorbing in the spectral region at which the photoconductive layer generates and injects photo-generated holes but being capable of supporting the injection of photo-generated holes from said photoconductive layer and transporting said holes through said electrically active material.

14. The member according to claim 13 wherein the polycarbonate resin has a Mw of from about 20,000 to about 100,000.

15. The member according to claim 13 wherein the polycarbonate resin has a Mw of from about 20,000 to about 50,000.

16. The member according to claim 13 wherein the polycarbonate resin has a Mw of from about 50,000 to about 100,000.

17. The member according to claim 13 wherein the polycarbonate resin is poly(4,4'-isopropylidene-diphenylene carbonate) having a Mw of from about 35,000 to about 40,000.

18. The member according to claim 13 wherein the polycarbonate resin is poly(4,4'-isopropylidene-diphenylene carbonate) having a Mw of from about 40,000 to about 45,000.

19. An imaging member comprising a photoconductive layer comprising an insulating organic resin matrix containing therein trigonal selenium particles, with substantially all of the trigonal selenium particles being in substantial particle-to-particle contact in said layer in a multiplicity of interlocking photoconductive paths through the thickness of said layer, said photoconductive paths being present in a volume concentration, based on the volume of said layer, of from about 1 to 25 percent, and a contiguous layer of electrically active material consisting essentially of an electrically inactive polycarbonate resin having dispersed therein from about 15 to about 75 percent by weight of bis(4-diethylamino-2-methylphenyl)phenylmethane, said photoconductive layer exhibiting the capability of photo-generation of holes and injection of said holes and said electrically active material being substantially non-absorbing in the spectral region at which the photoconductive layer generates and injects photo-generated holes, but being capable of supporting the injection of photo-generated holes from said trigonal selenium and transporting said holes through electrically active material.

20. The member according to claim 19 wherein the polycarbonate resin has a Mw of from about 20,000 to about 100,000.

21. The member according to claim 19 wherein the polycarbonate resin has a Mw of from about 20,000 to 50,000.

22. The member according to claim 19 wherein the polycarbonate resin has a Mw of from about 50,000 to about 100,000.

23. The member according to claim 19 wherein the polycarbonate resin is poly(4,4'-isopropylidene-diphenylene carbonate) having a Mw of from about 35,000 to about 40,000.

24. The member according to claim 19 wherein the polycarbonate resin is poly(4,4'-isopropylidene-diphenylene carbonate) having a Mw of from about 40,000 to about 45,000.

25. A method of imaging which comprises:

a. providing an imaging member comprising a layer of trigonal selenium and a contiguous layer of electrically active material consisting essentially of an electrically inactive polycarbonate resin having dispersed therein from about 15 to about 75 percent by weight of bis(4-diethylamino-2-methylphenyl)-phenylmethane, said trigonal selenium exhibiting the capability of photo-generation of holes and injection of said holes, and said electrically active material being substantially non-absorbing in the spectral region at which the trigonal selenium generates and injects photo-generated holes but being capable of supporting the injection of photo-generated holes from said trigonal selenium and transporting said holes through said electrically active material;

b. uniformly electrostatically charging said member, followed by;

c. imagewise exposing said charged member to a source of activating radiation to which the trigonal selenium is absorbing and to which the layer of electrically active material is non-absorbing, whereby the photo-generated holes from said trigonal selenium are injected into and are transported through said layer of electrically active material to form a latent electrostatic image on the surface of said member.

26. A method of imaging which comprises:

a. providing an imaging member comprising trigonal selenium dispersed in a resinous binder and a contiguous layer of electrically active material consisting essentially of an electrically inactive polycarbonate resin having dispersed therein from about 15 to about 75 percent by weight of bis(4-diethylamino-2-methylphenyl)phenylmethane, said photoconductive layer exhibiting the capability of photo-generation of holes and injection of said holes and said electrically active material being substantially non-absorbing in the spectral region at which the photoconductive layer generates and injects photo-generated holes but being capable of supporting the injection of photo-generated holes from said photoconductive layer and transporting said holes through said electrically active material;

b. uniformly electrostatically charging said member followed by c. imagewise exposing said charged member to a source of activating radiation to which the trigonal selenium dispersed in a resinous binder is absorbing and to which the layer of electrically active material is non-absorbing, whereby the photo-generated holes generated by said trigonal selenium dispersed in a binder are injected into and are transported through said layer of electrically active material to form a latent electrostatic image on the surface of said member.

27. A method of imaging which comprises:

a. providing an imaging member comprising a photoconductive layer comprising an insulating organic resin matrix and trigonal selenium, with substantially all of the trigonal selenium in said layer in a multiplicity of interlocking photoconductive continuous paths through the thickness of said layer, said photoconductive paths being present in a volume concentration, based on the volume of said layer, of from about 1 to 25 percent and a contiguous layer of electrically active material consisting essentially of an electrically inactive polycarbonate resin having dispersed therein from about 15 to about 75 percent by weight of bis(4-diethylamino-2-methylphenyl)phenylmethane, said photoconductive layer exhibiting the capability of photo-generation of holes and injection of said holes and said electrically active material being substantially non-absorbing in the spectral region at which the photoconductive layer generates and injects photo-generated holes but being capable of supporting the injection of photo-generated holes from said photoconductive layer and transporting said holes through said electrically active material;

b. uniformly electrostatically charging said member, followed by;

c. imagewise exposing said charged member to a source of activating radiation to which the trigonal selenium is absorbing and to which the layer of electrically active material is non-absorbing, whereby the photo-generated holes generated by said trigonal selenium are injected into and are transported through said layer of electrically active material to form a latent electrostatic image on the surface of said member.

28. A method of imaging which comprises:

a. providing an imaging member comprising a photoconductive layer comprising an insulating organic resin matrix containing therein trigonal selenium particles, with substantially all of the trigonal selenium particles being in substantial particle-to-particle contact in said layer in a multiplicity of interlocking photoconductive paths through the thickness of said layer, said photoconductive paths being present in a volume concentration, based on the volume of said layer, of from about 1 to 25 percent, and a contiguous layer of electrically active material consisting essentially of an electrically inactive polycarbonate resin having dispersed therein from about 15 to about 75 percent by weight of bis(4-diethylamino-2-methylphenyl)phenylmethane, said photoconductive layer exhibiting the capability of photo-generation of holes and injection of said holes and said electrically active material being substantially non-absorbing in the spectral region at which the photoconductive layer generates and injects photo-generated holes, but being capable of supporting the injection of photo-generated holes from said inorganic photoconductive material and transporting said holes through said electrically active material;

b. uniformly electrostatically charging said member, followed by;

c. imagewise exposing said charged member to a source of activating radiation to which the trigonal selenium is absorbing and to which the layer of electrically active material is non-absorbing, whereby the photo-generated holes generated by said trigonal selenium are injected into and are transported through said layer of electrically active material to form a latent electrostatic image on the surface of said member.

* * * * *